US007575337B2

(12) United States Patent
Wu et al.

(10) Patent No.: US 7,575,337 B2
(45) Date of Patent: Aug. 18, 2009

(54) LAMP STRUCTURE

(75) Inventors: Cheng Hsiu Wu, Taipei (TW); Chih Chun Li, Taipei (TW)

(73) Assignee: Feton Limited Berwell Hardware Ltd., Taipei (TW)

( * ) Notice: Subject to any disclaimer, the term of this patent is extended or adjusted under 35 U.S.C. 154(b) by 0 days.

(21) Appl. No.: 11/949,995

(22) Filed: Dec. 4, 2007

(65) Prior Publication Data

US 2009/0091939 A1 Apr. 9, 2009

(30) Foreign Application Priority Data

Oct. 3, 2007 (TW) ..... 96216501 U

(51) Int. Cl.
*F21V 33/00* (2006.01)

(52) U.S. Cl. ..... 362/206; 362/155; 362/133

(58) Field of Classification Search ..... 362/94, 362/132, 133, 155, 200, 205, 206, 295, 362, 362/394

See application file for complete search history.

(56) References Cited

U.S. PATENT DOCUMENTS 1,295,497 A * 2/1919 Henderson et al. ..... 362/206
2,156,462 A * 5/1939 Schulte ..... 362/94
2,172,523 A * 9/1939 Soreng ..... 362/394
5,032,957 A * 7/1991 Canfield ..... 362/133

* cited by examiner

*Primary Examiner*—Y My Quach Lee

(57) ABSTRACT

The present invention relates to a lamp structure characterized in which the lamp structure is installed inside a cabinet where the opening of the cabinet door turns on the electrical loop of the lamp structure and the closing of the cabinet door shuts off its electrical loop; when the electrical loop is charged, the illuminating part of the lamp structure produces light rays to illuminate the inside of the cabinet that allows clear viewing of the positions of objects inside.

10 Claims, 5 Drawing Sheets

LAMP STRUCTURE

FIELD OF THE INVENTION

The present invention relates to a lamp structure, particularly a lamp structure that can be turned on or off by touching a movable tongue member.

BACKGROUND OF THE INVENTION

Cabinets on the market in general meet the aesthetic and pragmatic demands, but not necessarily the general demand for convenience. The illumination is apparently one of the problems. Cabinets are commonly seen furniture in homes and offices. But the majority of cabinets do not come with illumination fixture, or if they do, they tend to be much more expensive and mostly require an external plug, hence not as convenient as desired. This invention is the product of research, design and continuous modification.

SUMMARY OF THE INVENTION

The invention relates to a lamp structure. The primary object of the invention is to provide a lamp structure that provides illumination when user opens the cabinet door.

The invention relates to a lamp structure, comprising a housing consisting of a casing structure with a hollow member and containing an opening member on partial surface that communicates with the hollow member; an illumination member consisting of an illumination element being arranged inside the housing; a power supply member being a power supply arranged in the hollow member of the housing; an electrical loop member being an electrical loop electrically connected to the illumination member and the power supply member, and the electrical loop member comprising a first electric terminal and a second electric terminal, the first electric terminal and the second electric terminal being generally in electrically disconnected state; a tongue member being a mechanical element that is slidably disposed inside the housing and confined between a first position and a second position, and includes an extension member which penetrates through the opening member and generally protrudes from the outer surface of the housing, the tongue member having a conductive piece thereon, the conductive piece being an electric conductor corresponding to the first electric terminal and the second electric terminal; and an elastic element being a mechanical element with recoil force and having one end being disposed in the power supply member and the other end being connected to the tongue member, wherein the conductive piece of the tongue member selects either the state of connection or disconnection between the first electric terminal and the second electric terminal; the two electric terminals being in the state of connection when the conductive piece is electrically connected to them and being in the state of disconnection when the conductive piece disengages from them; the first position corresponds to the disconnection state as selected by the tongue member, while the second position corresponds to the connection state as selected by the tongue member; and the position at where the extension member protrudes from the housing surface corresponds to any position between the first position and second position of the tongue member.

The objects, features and method of the invention as well as implementation of the invention are described in detail below with embodiments in reference to the accompanying drawings.

DETAILED DESCRIPTION OF THE INVENTION

Figure 1:
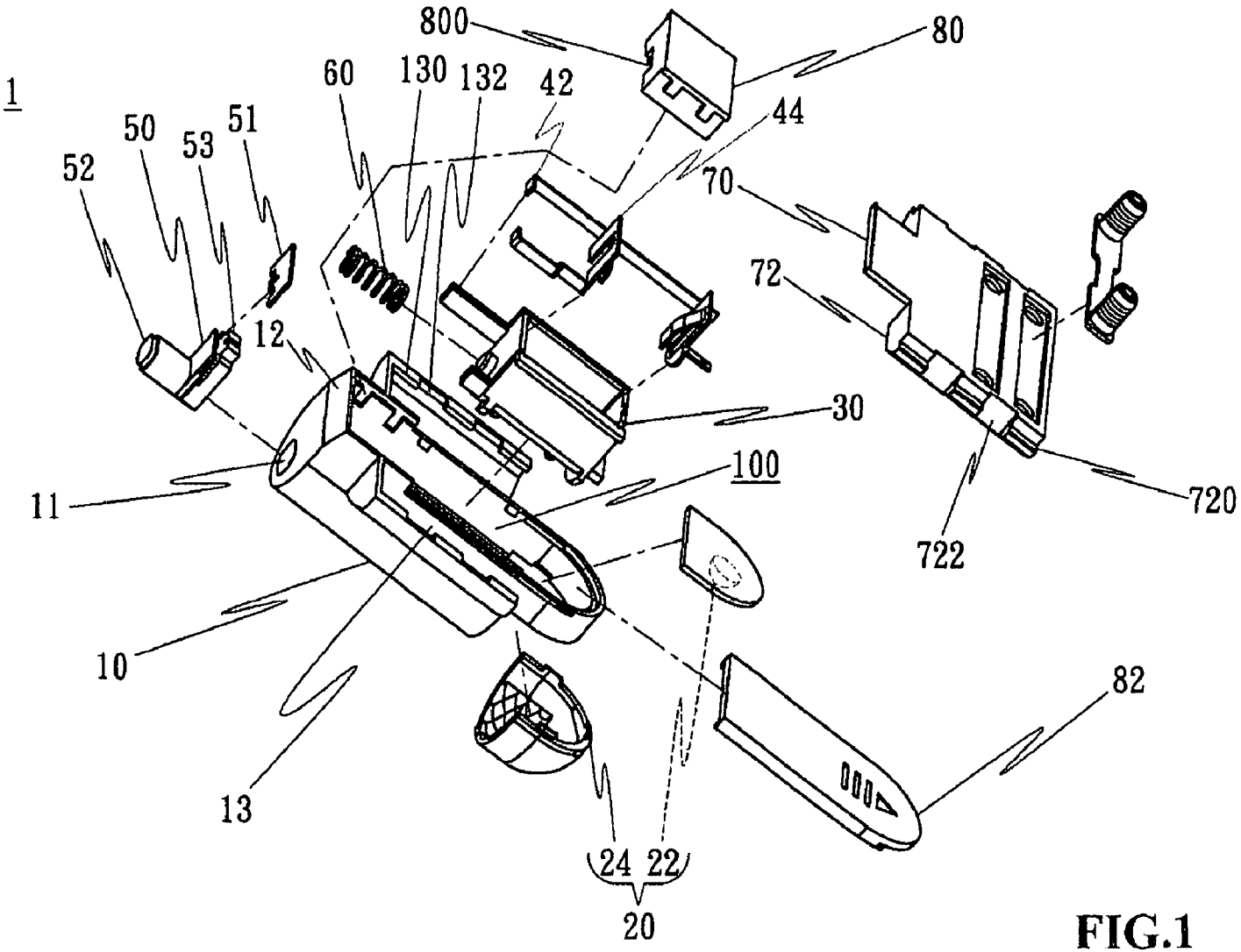
FIG. 1 is an exploded view of the lamp structure according to the invention.
Figure 2:
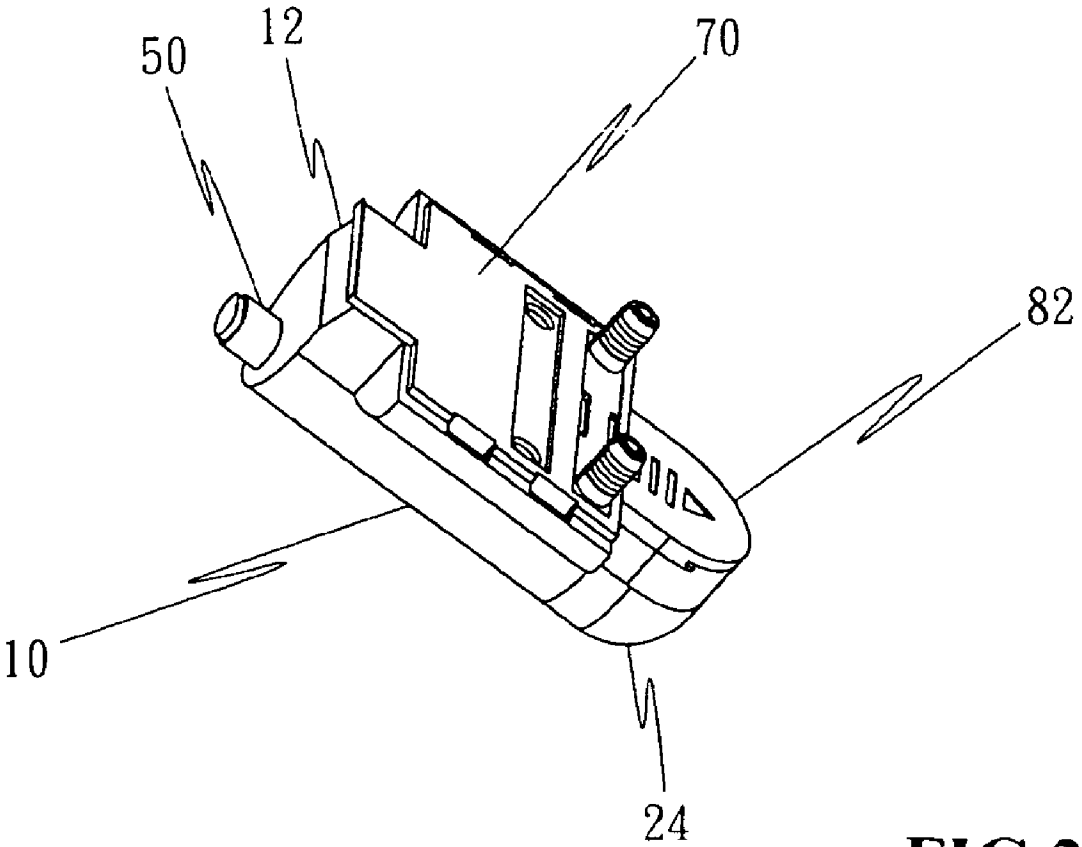
FIG. 2 is an assembly view of the lamp structure according to the invention.
Figure 3:
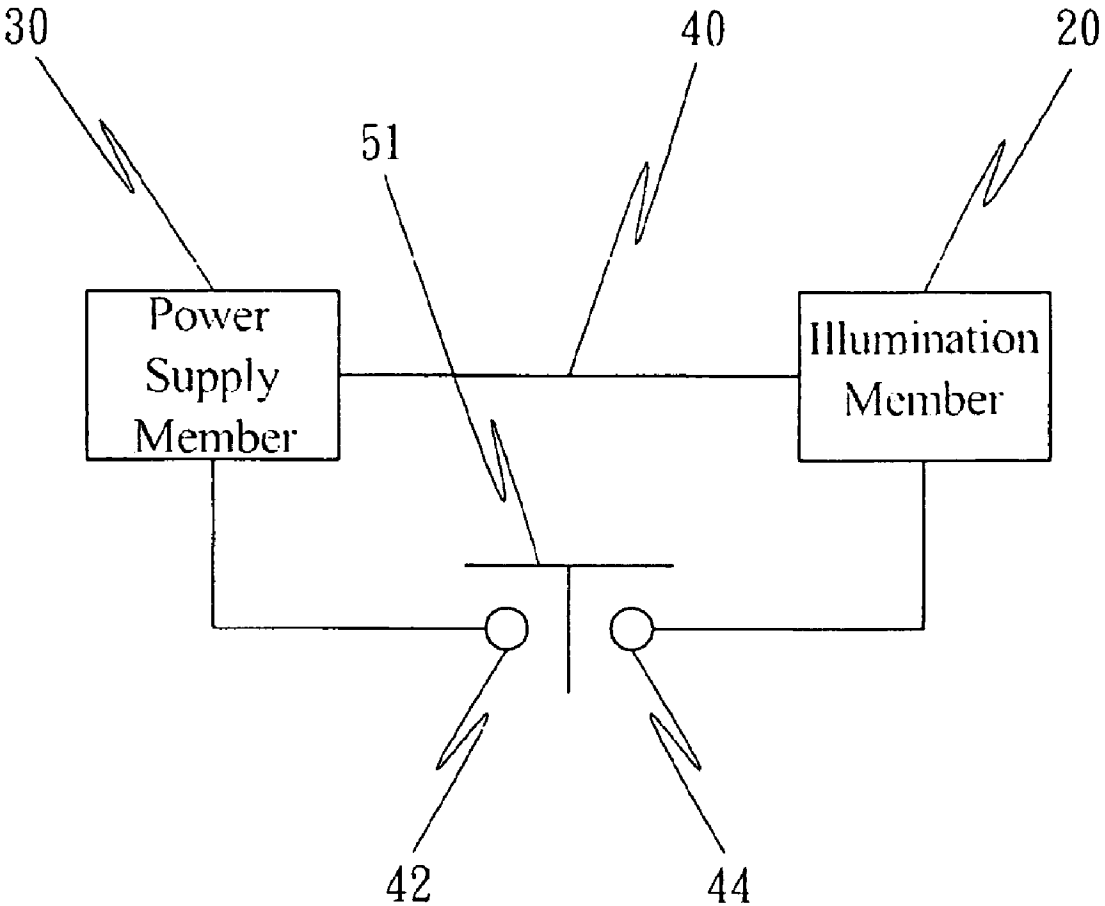
FIG. 3 is a diagram illustrating the electric connection between elements of the lamp structure according to the invention.
Figure 4:
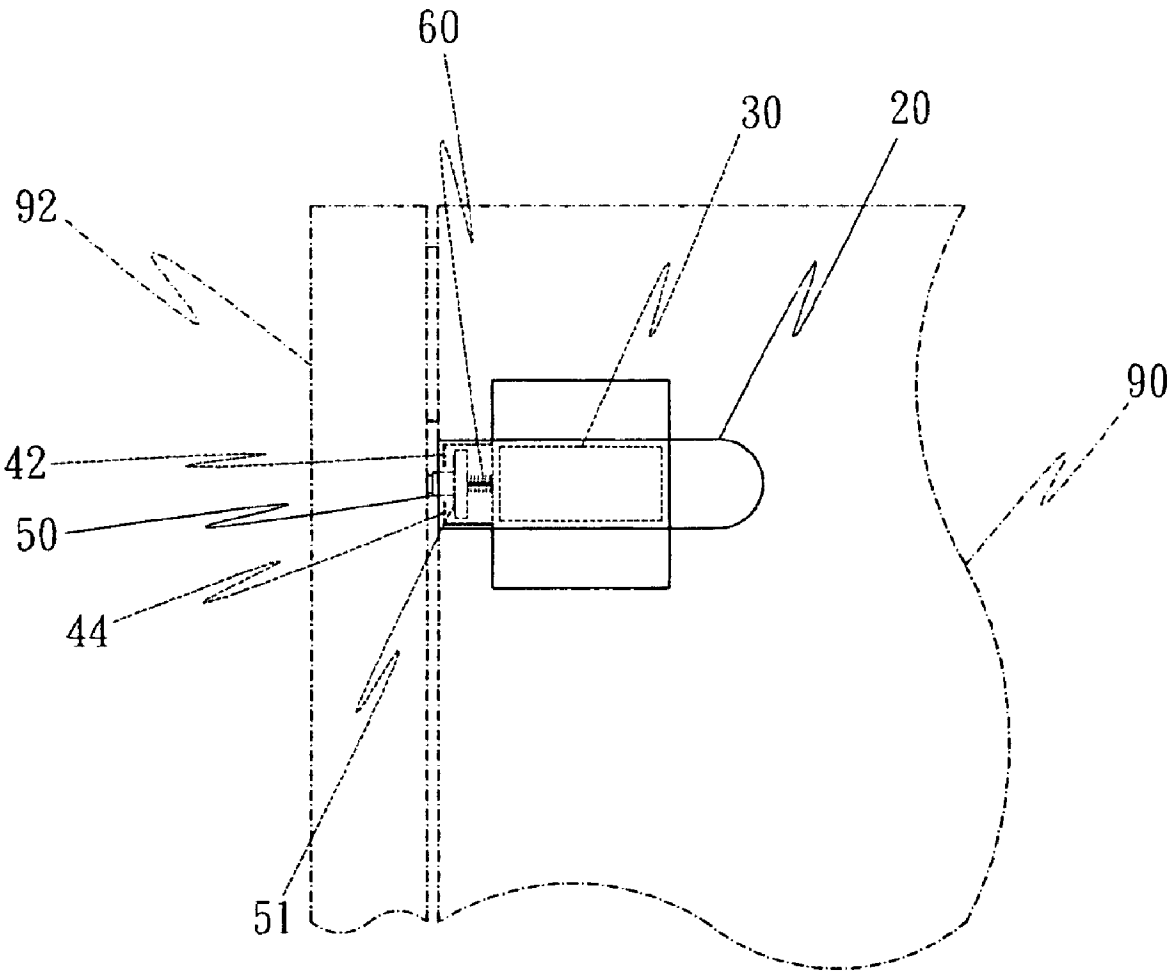
FIG. 4 is a diagram depicting the first position state of the lamp structure according to the invention.
Figure 5:
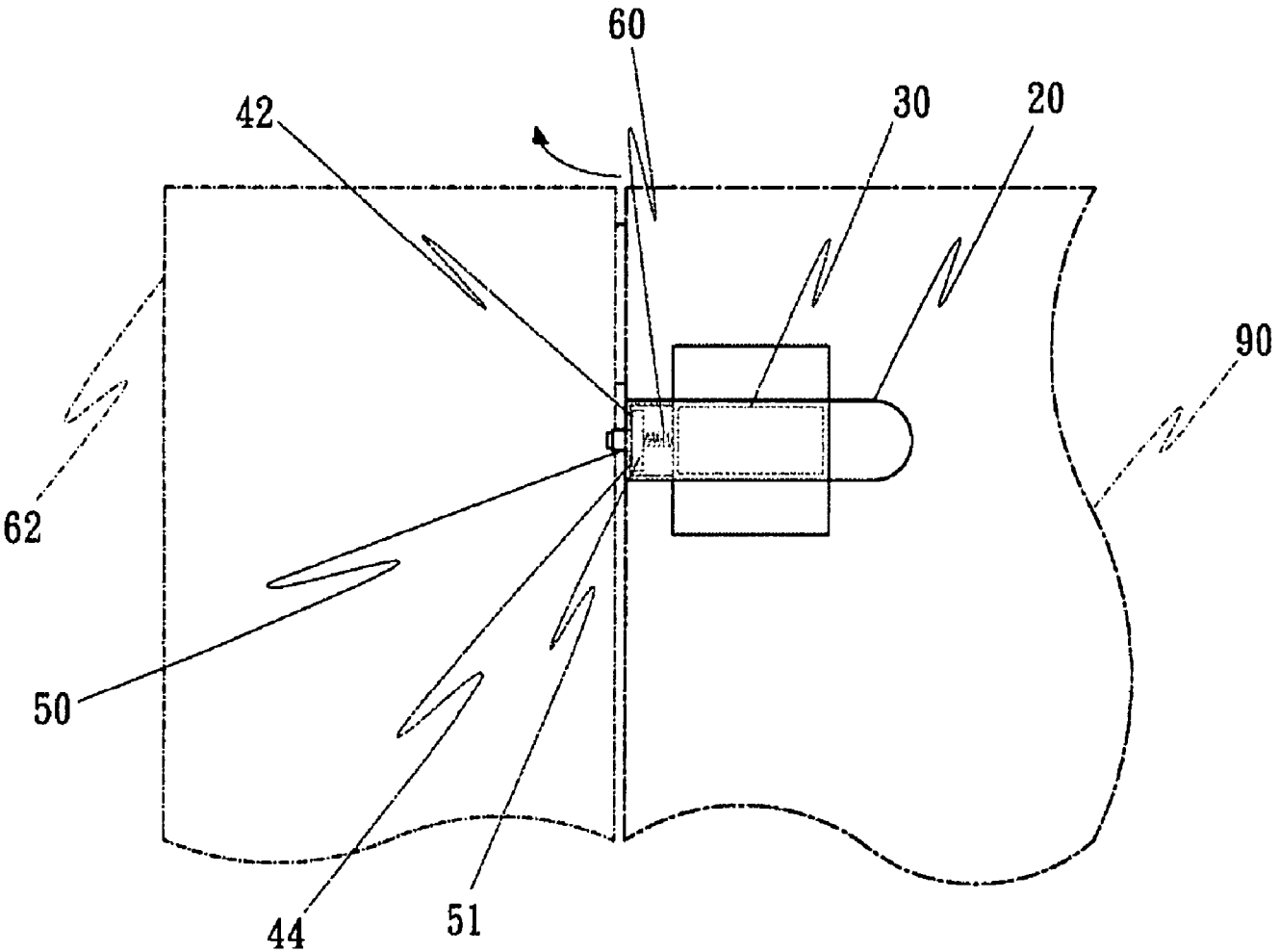
FIG. 5 is a diagram depicting the second position state of the lamp structure according to the invention.

Referring to FIGS. 1~5, FIG. 1 is an exploded view of the lamp structure according to the invention; FIG. 2 is an assembly view of the lamp structure according to the invention; FIG. 3 is a diagram illustrating the electric connection between elements of the lamp structure according to the invention; FIG. 4 is a diagram depicting the first position state of the lamp structure according to the invention; and FIG. 5 is a diagram depicting the second position state of the lamp structure according to the invention. The lamp structure (1) of the invention comprises a housing (10), an illumination member (20), a power supply member (30), an electrical loop member (40) (as shown in FIG. 3), a tongue member (50), an elastic element (60), and a stationary board (70). An embodiment of the invention is described in detail below.

In the lamp structure (1) of the invention, the housing (10) is a casing structure with a hollow member (100), at one end of the housing (10) there being provided an opening member (11) that communicates with the hollow member (100), and penetrates through the hollow member (100) to the exterior of the housing (10). The outer edge of the end of the housing (10) at where the opening member (11) is formed has a beveled guide plane (12), which reduces the volume of the housing (10) while adding to the convenience of housing (10) installation.

In the lamp structure (1), the illumination member (20) includes one or a plurality of illuminating elements (22), the illuminating elements (22) being a light-emitting diode (LED) or any light source driven by DC power. The illumination member (20) can further include a transparent shade body (24) being engaged to a lateral opening at the other end of the housing (10) and covering the illuminating elements (22).

The transparent shade body (24) can have an optical structure such as an optical lens arrays or a marking structure with special design to soften the light rays emitted by the illuminating element (22) passing through, or redirect the path of light rays to confine the effective irradiating direction of the light rays.

In the lamp structure (1), the power supply member (30) provides the power source for the lamp structure (1). More specifically in an embodiment, the power supply member (30) is assembled in the hollow member (100) of the housing (10). The power supply member (30) contains a battery holder to support a general battery (not shown in the figures) for the power supply. The power supply member (30) can also be a power source outside the housing (10). Specifically, the power supply member (30) is an external battery pack or a transformer, electrically connected to the city power system. The electrical connection that guides the power supplied by the power supply member (30) to the electrical loop member (40) such that the power needed by the illumination member (20) can be supplied sufficiently. Further, a locater is disposed at an outer side of the power supply member (30) to face the opening member 11 after the power supply member (30) is placed in the housing (10) for locating an end of an elastic member (60), which will be described afterwards.

In the lamp structure (1), the electrical loop member (40) is an electrical loop electrically connecting the illumination member (20) to the power supply member (30), and comprising a first electric terminal (42) and a second electric terminal (44). The first electric terminal (42) and the second electric terminal (44) are in the state of disconnection and arranged at the inner side of the end with the opening member 11 with the other ends thereof extending the power supply member (30) respectively. In addition, the first electric terminal (42) and the second electric terminal (44) can respectively be a plate body with conductivity that is made of conductive material or a non-conductive baseboard with conductive material arranged thereon.

In the lamp structure (1), the tongue member (50) is arranged inside the hollow member (100) of the housing (10) and confined to move between the first position (as shown in FIG. 4) and the second position (as shown in FIG. 5), and disposed with a conductive piece (51) thereon. The conductive piece (51) is a conductor attached to a side of the tongue member (50) to correspond to the first electric terminal (42) and the second electric terminal (44). The tongue member (50) further comprises an extension member (52) extending outward from the side attached with the conductive piece (51) and a guide block (53) facing the other lateral opening of the hollow member 100 When the tongue member (50) is at the first position, the extension member (52) is retracted inside the hollow member (100) via the opening member (11); and when the tongue member (50) is at the second position, the extension member (52) protrudes outward the housing via the opening member (11).

Moreover, under the action of the recoil force of the elastic element (60), the extension member (52) is not subjected to an external force such that the position corresponding to the conductive piece (51) is in contact with the first electric terminal (42) and the second electric terminal (44) to charge the electrical loop member (40); when the extension member (52) is under the push of the external force, the conductive piece (51) disengages the first electric terminal (42) and the second electric terminal (44) such that the electrical loop member (40) is in an electrically disconnected state.

The hollow member (100) of the housing (10) is further coupled with a first plate body (80) and a second plate body (82), wherein the first plate body (80) is disposed between a first position and a second position where the tongue member (50) can move therebetween and covers one end of the hollow member (100). The second plate body (82) covers other parts on said end of the hollow member (100). The first plate body (80) has a guide groove (800) that can be coupled with the guide block (53). The coupling of guide block (53) and the guide groove (800) is to confine the moving direction of the tongue member (50) such that it only moves between the first position and the second position.

The elastic element (60) is a mechanical element with recoil force, such as a spring, a spring sheet or a block made of elastic material. One end of the elastic element (60) is disposed inside the hollow member (100), while the other end is mechanically connected to one end of the tongue member (50), wherein one end of the elastic member (60) is disposed at the external side of the power supply member (30) in the hollow member (100).

In the lamp structure (1), the conductive piece (51) of the tongue member (50) can select the state between the first electric terminal (42) and the second electric terminal (44) to be disconnected or connected; the two electric terminals are in the state of connection when the conductive piece (51) is electrically connected to them and being in the state of disconnection when the conductive piece (51) disengages from them; the first position corresponds to the disconnection state as selected by the tongue member (50), while the second position corresponds to the connection state as selected by the tongue member (50); and the position at where the extension member (52) protrudes from the housing (10) surface corresponds to any position between the first position and second position of the tongue member (50).

Referring further to FIG. 4 and FIG. 5 which shows respectively a diagram with the lamp structure of the invention inside a cabinet in first position and second position, the lamp structure (1) can be used in a cabinet (90), in which a stationary board (70) is premounted securely inside the cabinet (90). After the stationary board (70) is mounted on the cabinet (90), the housing (10) is assembled to the stationary board (70), wherein the two opposing sides at one end of the stationary board (70) are each extended with a protruding block (72), and the corresponding sides of the housing (10) are each configured with an insertion slot (13) that matches the protruding block (72). The insertion slot (13) has an inwardly extended wing member (130) on the side, whereas the protruding block (72) has a flange (720) on one side that matches the wing member (130). The wing member (130) is further disposed with a first trough member (132), and the protruding block (72) is disposed with a second trough member (722) at the side of the flange (720). The part of protruding block (72) next to the second trough member (722) can be inserted directly into the first trough member (132), and the part next to the first trough member (132) can also be inserted into the second trough member (722). Such design aims to reduce the path length during assembly to cut down the time of assembly by user.

Again referring to FIG. 4 and FIG. 5, the lamp structure (1) is installed inside the cabinet (90) by screwing or latching the stationary board (70) securely inside the cabinet (90) (this is not a feature of the invention, hence will not be elaborated). Next as described above, the housing (10) is assembled on the stationary board (70) with its opening member (11) facing the exterior of the cabinet (90) and the side of housing (10) with illumination member (20) facing the interior of the cabinet (90). When a door (92) of the cabinet (90) is closed, the door (92) would push the extension member (52) to cause the tongue member (50) move inwardly inside the housing (10), which drives the guide block (53) to move in the guide groove (800) to reach a predetermined first position. As such, the elastic element (60) is also squeezed and compressed so that the conductive piece (51) on the tongue member (50) would disengage the first electric terminal (42) and the second electric terminal (44) and results in electric disconnection. As such, the illumination member (20) does not produce light rays. Conversely, if the door (92) of the cabinet (90) is open such that the door (92) cannot exert force on the extension member (52), the elastic member (60) will release the recoil force to push the tongue member (50) and protrude the extension member (52) out of the opening member (11) which causes the tongue member (50) to move to the predetermined second position. As such, the conductive piece (51) is in contract with the first electric terminal (42) and the second electric terminal (44). At this time, the circuit is charged and the illumination member (20) can produce light to illuminate the interior of the cabinet (90).

The side of the housing (10) opposing the tongue member (50) has a beveled guide plane (12) to prevent the mechanical interference between the cabinet door (92) and the housing (10) when mounting the housing (10) inside the cabinet (90), hence rendering the installation of housing (10) more convenient.

As described above, the invention provides a lamp structure that allows the user to light up the interior of a cabinet. The invention possesses inventive step and meets the essential criteria for new utility patent.

The present invention has been disclosed in detail. However the disclosed embodiment should not be construed as a limitation on the actual applicable scope of the invention, and as such, all modifications and alterations without departing from the spirits of the invention and appended claims shall remain within the protected scope and claims of the invention.

What is claimed is:

1. A lamp structure comprising:

a housing being a casing structure with a first end, a second end, two opposite sides, a first lateral opening and a second lateral opening, and further comprising a hollow member between said first end and second end, an opening member at said first end to communicate with the hollow member, and an insertion slot being disposed at said two opposite sides respectively with a plurality of wing members and first trough members alternately provided an outer edge of the insertion slot;

a stationary board oppositely extending outward a protruding block with a plurality of flanges and second trough members alternately provided at an outer edge of the respective protruding block corresponding to the first trough members and the wing members such that the stationary board is capable of joining with the insertion slots;

an illumination member further comprising at least an illumination element being arranged inside the second end of the housing;

a power supply member being arranged in the hollow member of the housing and having a locater disposed at an outer side thereof to face said opening member for receiving a battery;

an electrical loop member being electrically connected to the illumination member and further comprising a first electric terminal and a second electric terminal, which are disposed at an inner side of said first end and extending to the power supply member and generally in an electrically disconnected state;

a tongue member, which is a mechanical element with a first side and a second side, being slidably disposed inside the housing next to said first end and capable of moving between a first position and a second position, and further comprising an extension member, which extends from said first side, penetrates through the opening member and generally protrudes outward the housing, and a conductive piece, which is an electric conductor and disposed at said first side corresponding to the first electric terminal and the second electric terminal; and an elastic element, which is a mechanical element disposed between the tongue member and the power supply member with one end being supported with said locator of the power supply member and the other end being connected to said second side of the tongue member;

wherein when the the tongue member is positioned at the first position and the extrusion member is in a state without being pressed, the conductive piece electrically connects with the first electric terminal and the second electric terminal; and when the tongue member is positioned at the second position and the extrusion member is in a state of being pressed against a recoil force of said elastic element, the conductive piece electrically disengages from the two electric terminals.

2. The lamp structure according to claim 1, wherein the first end of the housing has a beveled guide plane.

3. The lamp structure according to claim 1, wherein the power supply member includes a battery holder.

4. The lamp structure according to claim 1, wherein the tongue member has a guide block extending toward said first lateral opening of the hollow member.

5. The lamp structure according to claim 4, wherein is a first plate body, which has a guide groove extending from the first position to the second position for coupling with the guide block, is provided to cover a part of said first lateral opening next to the first end of the housing.

6. The lamp structure according to claim 5, wherein the tongue member with the guide block is capable of moving along the guide groove to the first position or the second position.

7. The lamp structure according to claim 5, wherein a second plate body is provided to cover the other part of said first lateral opening and the second lateral opening next to the second end of the housing.

8. The lamp structure according to claim 7, wherein the stationary board is disposed next to the first plate body and the second plate body after the wing members and the first trough members engage with the second trough members and the flanges respectively.

9. The lamp structure according to claim 6, wherein the elastic element is a spring.

10. The lamp structure according to claim 1, wherein the illumination member further comprises a transparent shade body to engage with said second opening at the second end of the housing and cover the illuminating elements.

* * * * *